US008137251B2

(12) United States Patent
Tozzi

(10) Patent No.: US 8,137,251 B2
(45) Date of Patent: Mar. 20, 2012

(54) EXERCISE ASSEMBLY

(76) Inventor: Gino Adolfo Tozzi, Miami, FL (US)

( * ) Notice: Subject to any disclaimer, the term of this patent is extended or adjusted under 35 U.S.C. 154(b) by 0 days.

(21) Appl. No.: 12/586,799

(22) Filed: Sep. 28, 2009

(65) Prior Publication Data

US 2011/0077136 A1 Mar. 31, 2011

(51) Int. Cl.
*A63B 71/00* (2006.01)
*A63B 21/068* (2006.01)
*A63B 21/00* (2006.01)

(52) U.S. Cl. ..... 482/141; 482/95; 482/132

(58) Field of Classification Search ..... 482/142, 482/141, 907, 148, 126, 130, 132, 95, 96, 482/131; 108/147.21; 248/167, 436, 439
See application file for complete search history.

(56) References Cited

U.S. PATENT DOCUMENTS

| | | | | |
|---|---|---|---|---|
| 2,682,402 A | | 6/1954 | McCarthy | |
| 4,111,417 A | | 9/1978 | Gardner | |
| 4,678,187 A | | 7/1987 | Prsala | |
| 5,295,935 A | * | 3/1994 | Wang | 482/130 |
| 5,643,162 A | | 7/1997 | Landers et al. | |
| 5,921,901 A | * | 7/1999 | Palacios | 482/132 |
| 6,071,217 A | * | 6/2000 | Barnett | 482/121 |
| 6,186,930 B1 | * | 2/2001 | Ignaczak | 482/141 |
| 6,368,254 B1 | * | 4/2002 | Wall | 482/71 |
| 6,716,145 B1 | * | 4/2004 | Manailovich | 482/141 |
| 6,932,750 B1 | * | 8/2005 | Dorner | 482/142 |
| 7,108,643 B2 | | 9/2006 | Wilson et al. | |
| 7,125,367 B1 | * | 10/2006 | Stearns | 482/141 |
| 2004/0053752 A1 | * | 3/2004 | Yang | 482/70 |

* cited by examiner

*Primary Examiner* — Allana Lewin
(74) *Attorney, Agent, or Firm* — Malloy & Malloy, P.L.

(57) ABSTRACT

An exercise assembly structured to facilitate the performance, by an individual, of a plurality of different exercises depending on the orientation or position in which the exercise assembly is disposed. A base includes an elongated configuration and has a track assembly mounted thereon. Hand grips are movably connected to the base a manner which allows there reciprocal movement in opposite directions along different lengths of the base while also being capable of disposition in any one of a plurality of fixed locations along the track assembly. A support assembly is movably connected to the base and disposable in a supporting orientation and a non-supporting orientation, wherein the base is cooperatively disposed in a first or a second operative position depending on the supporting or non-supporting orientation of the support assembly. One or more accessories are connectable to the base and/or track assembly and are structured to facilitate the performance of an additional plurality of exercises thereon.

34 Claims, 7 Drawing Sheets

EXERCISE ASSEMBLY

BACKGROUND OF THE INVENTION

1. Field of the Invention

This invention is directed to an exercise assembly capable of being disposed in a plurality of different operative positions to facilitate the performance of a variety of exercises by an individual. In one operative position, the base of the exercise assembly is disposed in an upwardly and/or outwardly spaced orientation relative to a floor or similar support surface, thereby allowing the individual to practice a category of exercises while being disposed beneath the assembly. In another operative position, the base may be disposed in confronting, supported engagement with the floor or similar support surface, wherein a different category of exercises may be performed. The exercise assembly includes hand grips and/or other body engaging members which are ideally movable reciprocally along different lengths of a track assembly on the base, thereby allowing an individual's arms to be positioned in an outwardly directed, extended orientation or an inwardly directed, retracted orientation, while the base is in any of the operative positions.

2. Description of the Related Art

During contemporary times as well as for a number of years in the past, there has been increased attention to the many benefits associated with maintaining one's health through fitness. In fact, most doctors and medical experts recommend that people follow some sort of a regular exercise program, which may include performing both cardiovascular exercises as well as strength training exercises for certain muscle groups. Thus, and while exercise programs can differ significantly, they commonly involve the practice of a variety of different exercises and are recommended at least partially based upon an individual's age, physical ability, weight and/or stature, as well as his or her overall health, while taking into consideration any medical problems the individual may have. Accordingly, categories of exercise may be recommended which vary in intensity, duration and whether directed towards improving the cardiovascular system of the individual or selected muscle groupings. Regardless of the specific exercise program developed, exercise frequently involves the use of a plurality of different exercise machines or devices. Some conventional exercise apparatus may be primarily intended for cardiovascular development, while others are intended to develop specific muscle groups or parts of the participant's body.

It follows, however, that there is a perception by some as to disadvantages associated with an individual having to become familiar with and to use regularly a number of different exercise machines, in order to diligently follow many prescribed exercise programs. Few, if any of the known exercise machines or devices, which are commercially available, have sufficient versatility to enable an individual to practice different categories of exercise on the same machine or device. As a result, an individual is typically required to endure the expense of joining a commercial gym or training facility or alternatively, to purchase and maintain a plurality of "home devices" which are often advertised to the general public. It is believed, however, that many in this latter grouping of home exercise devices have been found to be less than completely effective, at least to the extent of demonstrating sufficient versatility and/or developing the body as advertised.

Accordingly, there is a need in the field of exercise apparatus for an assembly structured to have sufficient versatility to facilitate the performance of a plurality of different exercises, wherein each exercise category comprises a plurality of different exercises designed to develop different muscle groupings and/or systems of the body. If any such proposed exercise assembly were developed, it should also be efficiently structured and effectively operable to provide a long operable life, even when subjected to relatively significant forces while the exercises are being performed. In addition, any such exercise assembly, if developed, should be of relatively light weight construction to facilitate ease of positioning by individuals of various genders or age and also, be dimensioned and configured to facilitate storage thereof in a convenient location of comparatively small size. Finally, the structural and operable features of any such improved and proposed exercise assembly should allow the efficient performance of exercises of different categories which collectively and independently exercise the frontal and rear upper torso portions, arms, shoulders, wrists, hands, as well as the thighs and lower legs, dependent upon the specific exercise being performed.

SUMMARY OF THE INVENTION

The present invention is intended to present a solution to these and other needs which remain in the art, and is directed to an exercise assembly structured to facilitate the performance or practice of an extensive variety of exercises, or even categories of exercises, by an individual, thereby eliminating the need for an individual to purchase, store and use a plurality of different exercise devices.

Accordingly, and in a preferred embodiment, the exercise assembly of the present invention comprises a base having an elongated configuration. A track assembly is connected to or mounted on the base and extends along substantially the entire or at least a significant portion of the length thereof. Also, one or more body engaging members comprising at least one hand grip, but preferably two hand grips, or other body engaging members, are mounted on the base in movable relation to or engagement with the track assembly. When utilized, each of the two hand grips in the preferred embodiment are disposed and dimensioned to be gripped by a different hand of the individual. When so gripped, the hand grips and the user's hands may reciprocally move along different lengths of the track assembly, concurrently in opposite directions. This reciprocal, linear movement of the hand grips facilitates the arms of the individual being reciprocally disposed in an outwardly extended or expanded orientation and also in an inwardly directed at least partially retracted orientation.

Therefore, the length of the base and more specifically, the length of the track assembly are sufficient to allow the hands of the individual, while engaging the two hand grips, to be disposed in appropriate, spaced relation to one another, as the two hand grips move toward opposite longitudinal ends of the track assembly. This appropriate spacing between the hand grips and the hands of the individual allows the individual to extend his or her arms outwardly, well beyond the shoulders, up to and including a maximum, yet practical span of the individual's arms, while simultaneously performing various exercises. As set forth in greater detail hereinafter, the various exercises which the individual may perform, while reciprocally extending and retracting his/her arms, are dependent upon which of a possible plurality of operative positions the base and track assembly are disposed.

The exercise assembly of the present invention further comprises in the preferred embodiment a support assembly including ideally, at least two leg structures, with each movably connected adjacent opposite ends of the base. The two leg structures are selectively positionable into and out of a supporting orientation or a non-supporting orientation, thereby respectively defining the base and track assembly being disposed in at least a first operative position or second operative position. Moreover, the first operative position is at least partially defined by the base disposed in a predetermined spaced relation above a floor, ground or other supporting surface. In contrast, the second operative position comprises the base disposed in confronting engagement with the supporting surface, while the two leg structures are in the non-supporting orientation.

Further, when the base is disposed in the first operative position, the track assembly and more specifically, the hand grips are directed outwardly from the track assembly in a direction towards the supporting surface. In contrast, when the base is in the second operative position, the two hand grips are collectively disposed to extend outwardly from the track assembly in a direction away from the supporting surface. Therefore, the two hand grips are collectively disposed to extend outwardly from the base in substantially opposite directions when the base is disposed in the first operative position and the second operative position.

The first operative position is further defined by the support assembly being sufficiently dimensioned to position the base a predetermined distance above the supporting surface. As such, the predetermined space between the base and the supporting surface is sufficient to accommodate the individual, while exercising, beneath the base and the track assembly. When in such a position, the individual has full access to the two hand grips thereby facilitating the practice of a variety of exercises. Such exercises may involve the individual engaging the hand grips and performing the reciprocal, extended and retracted, movement of the arms and hands in the aforementioned manner.

Other features of the various preferred embodiments of the exercise assembly of the present invention include a selective, fixed positioning of the two hand grips relative to the track assembly instead of the aforementioned reciprocal movement of the hand grips. More specifically, a locking assembly is associated with each of the two hand grips and is disposed and structured to independently secure each hand grip in any one of a plurality of fixed locations along corresponding lengths of the track assembly. By way of example, when the base is in either of the first or second operative positions the individual may desire to perform an exercise which does not include the reciprocal expanding and retracting movement of the arms and hands.

Therefore, the locking assembly is structured to removably connect each of the hand grips in any one of a plurality of fixed locations. When the hand grips are so fixed, they are sufficiently stable to allow various exercises to be performed while being engaged by the individual. The selected, fixed position of the hand grips along the length of the track assembly will be dependent on the exercise(s) being performed and the stress the individual intends to place on the various muscle groups involved in the exercise. As such, the two hand grips may be removably but fixedly disposed in a location which substantially corresponds to the alignment thereof with corresponding ones of the shoulders of the individual. However, the cooperative structuring between the hand grips and the track assembly is such that the two hand grips may be disposed outwardly from the corresponding shoulders or inwardly relative thereto, again dependent upon the intent of the individual as well as the particular exercise being performed.

The versatility of the various embodiments of the exercise assembly of the present invention is further evidenced by additional movement and positioning of the two hand grips which further facilitates the exercising of various muscle groups, as well as the performance of different categories of exercise. More specifically, each of the two hand grips, in addition to being moved in a linear, reciprocal manner along corresponding lengths of the track assembly may also be independently rotated relative to the track assembly. This rotational movement may also occur while the hand grips are disposed in any one of the plurality of fixed locations, as set forth above.

Accordingly, the various preferred embodiments of the exercise assembly of the present invention demonstrates significant versatility over known or conventional exercise assemblies by allowing a plurality of different exercises or different categories of exercise to be performed thereon, depending on the base and track assembly being disposed in either a first operative position or a second operative position, as described above. As a result, the exercise assembly of the present invention eliminates or significantly reduces the necessity of acquiring and/or using a plurality of different conventional exercise apparatus or having to visit a commercial gym or training facility.

By way of example, the various exercises that may be performed utilizing the various embodiments of the present invention include a push-up type exercise, with the individual's arms being concurrently movable, reciprocally between the expanded orientation and the retracted orientation and/or the arms and hands of the individual being disposed in a substantially but adjustably determined fixed location relative to the length of the track assembly. In addition, when the base of the exercise assembly is in the first operative orientation, and the individual is operatively disposed beneath the base, a "crunch" or sit-up type of exercise may be performed, wherein the individual works the abdominal muscles and other muscles of the upper torso and arms. Similarly, when this category of exercise is being performed, the arms and hands of the individual may be reciprocally movable between the expanded and retracted positions along the length of the track assembly. Alternatively, each of the hand grips may be adjustably and removably disposed in a fixed location either outside or inside corresponding ones of the shoulders of the individual. Further, in each of the different categories of exercises, the hand grips may be concurrently and reciprocally rotated during the linear travel thereof or during the removable but fixed location of the hand grips.

In order to further enhance the versatility of the exercise assembly of the present invention, yet another preferred embodiment comprises the provision of at least one or alternatively a plurality of accessories disposed on or connected to the base and/or the track assembly. Such one or more accessories facilitates individual performing yet an additional category of exercises, which may be generally referred to as "torso extensions". Further by way of example, this category of exercise involves the knees or other appropriate portions of the individual's body resting on and supported by an outboard support structure. This outboard support structure is connected to the base and extends outwardly there from in substantially alignment with the length thereof. When in such a position, the individual may grip and cause a linear, reciprocal movement of at least one of the hand grips, thereby causing the torso of the individual to be successively extended linearly outward along the length of the base and retracted back, into a kneeling or partially crouching position.

Also, an additional accessory may be used with the outboard support structure, such as by being connected to the track assembly so as to be movable along the length thereof, similar to but instead of one of the hand grips. This additional accessory may be a body engaging member in the form of a handle assembly preferably comprising two elongated handles disposed in adjacent but spaced, substantially parallel relation to one another. The handle assembly may be substituted for one or both of the hand grips and will force the individual to grip the handle assembly in a different manner than one would normally grip the hand grips. In turn, the handle assembly will force the individual to exercise at least some different muscle groups than would normally be exercised when the individual grips and utilizes one of the two hand grips.

Additional accessories may be used to define yet another embodiment of the present invention and include body engaging members differing from and used instead of the hand grips and or the aforementioned handle assembly. More specifically, the body engaging members of this additional embodiment comprise two knee pads reciprocally movable along the length of the track assembly. Each of the knee pads is structured to movably support a different knee of the exercising individual in a manner which allows the individual to perform a "split-type" of exercise, wherein the legs are repeatedly spread open and drawn together. This exercise will thereby effectively exercise the thighs and other portions of the legs as well as the abdominal area. Additionally, a stabilizing member may be removably or otherwise secured to the base of the exercise assembly and/or supporting surface in a position and orientation to be gripped or held by the individual while the split-type exercise is being performed.

The structure and disposition of the one or more accessories, of the type set forth above, may be such as to further facilitate the orientation of the individual in different positions than that described in order to accomplish a torso extension and/or a split-type category of exercises, wherein the orientation of the individual varies and/or wherein other parts of the individual's body is supported on the support structure.

Accordingly, the various preferred embodiments of the track assembly of the present invention overcome numerous disadvantages and problems associated with conventional or known exercise assemblies. In addition, the size, structure and weight of the exercise assembly of the present invention including its various preferred embodiments and any of the one or more accessories which may be associated therewith, facilitates the storage, use and maintenance thereof in a home environment or other appropriate location. Also, utilization of the exercise assembly in its various operative orientations eliminates the need for a plurality of conventional exercise apparatus and/or the disadvantages relating to the time and expense of joining a commercial exercise or training facility.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
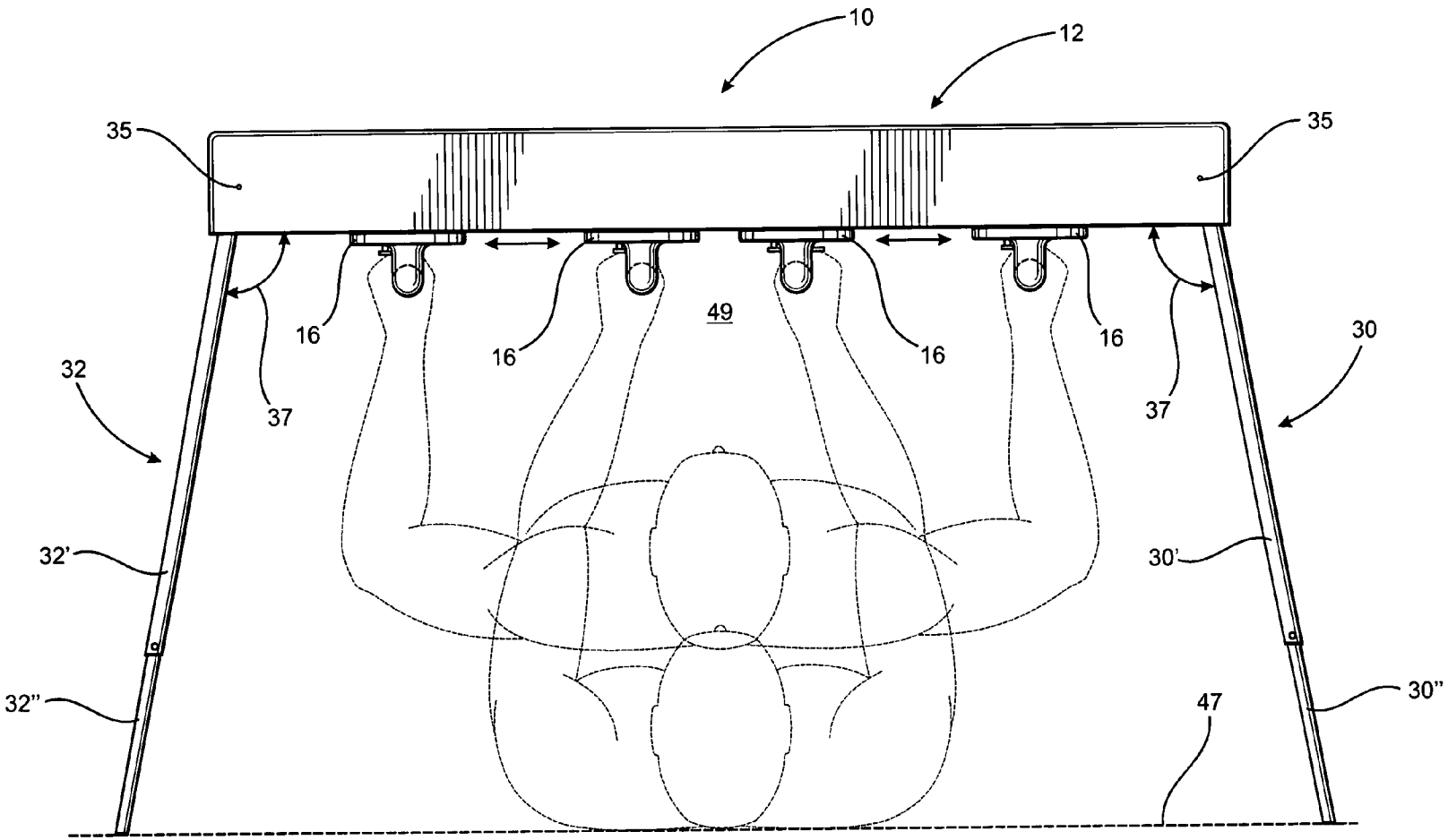
FIG. 1 is a front view in partial phantom of one preferred embodiment of the exercise assembly of the present invention when in a first of a plurality of operative positions.

As represented in the accompanying drawings, the present invention is directed to an exercise assembly generally indicated as 10 which is disposable in a plurality of operative positions. As such, an individual may perform a variety of different exercises using the exercise assembly 10 dependent, at least in part, on which of the plurality of operative positions the exercise assembly 10 is disposed.

The exercise assembly 10 includes a base generally indicated as 12 having a track assembly generally indicated as 14 disposed thereon. In addition, the exercise assembly 10 preferably includes at least two body engaging members in the form of two hand grips 16 cooperatively structured with the track assembly 14, so as to be reciprocally and concurrently movable along different portions of the length thereof, while being retained thereon. To accomplish such movable but retaining engagement of the hand grips 16, the track assembly 14 preferably includes elongated grooves 18 formed in and extending along the length of each oppositely disposed track rails 20. Further, the movable connection of the hand grips 16 to the track assembly 14 is facilitated by the provision of an open, substantially interior channel 22 having at least one open end 24 or alternatively opposite open ends 24 and 24'. Similarly, the elongated grooves 18 may also have at least one open end 18', as clearly represented in FIG. 2, which will facilitate the sliding, placement of each of the hand grips 16 in retained but movable engagement on or at least partially within the track rails 20.

Additional features of exercise assembly 10 include the provision of a support assembly in the form of two leg structures 30 and 32 each including two leg segments 30',30' and 32',32'. Further each of the leg structures 30 and 32, including the four leg segments 30' and 32', are selectively disposable in an outwardly extending, supporting orientation, as represented in FIG. 1, or in a collapsed, non-supporting orientation, as represented in FIGS. 2 and 3.

Figure 2:
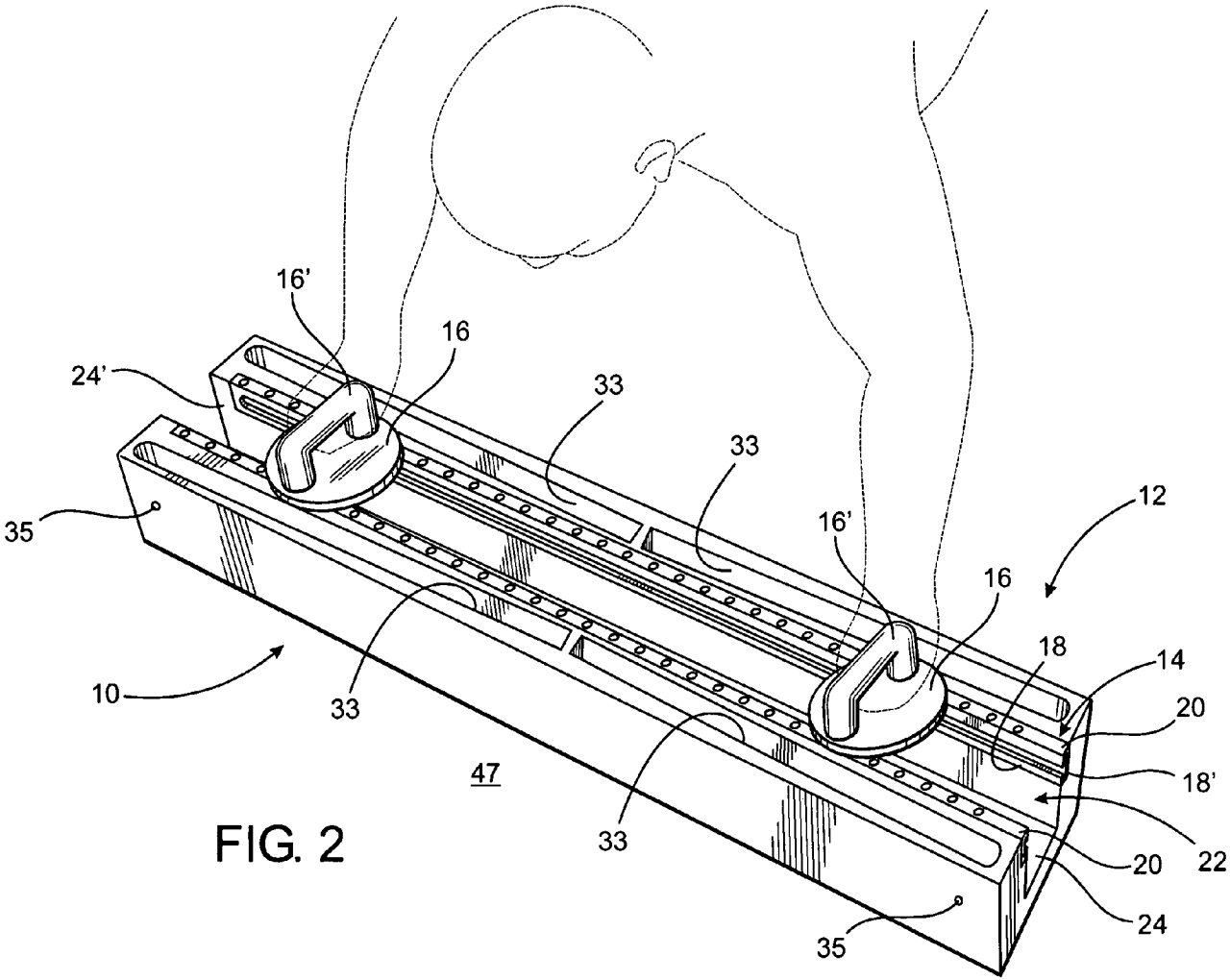
FIG. 2 is a perspective view in partial phantom wherein the exercise assembly is in a second of the plurality of operative positions.
Figure 3:
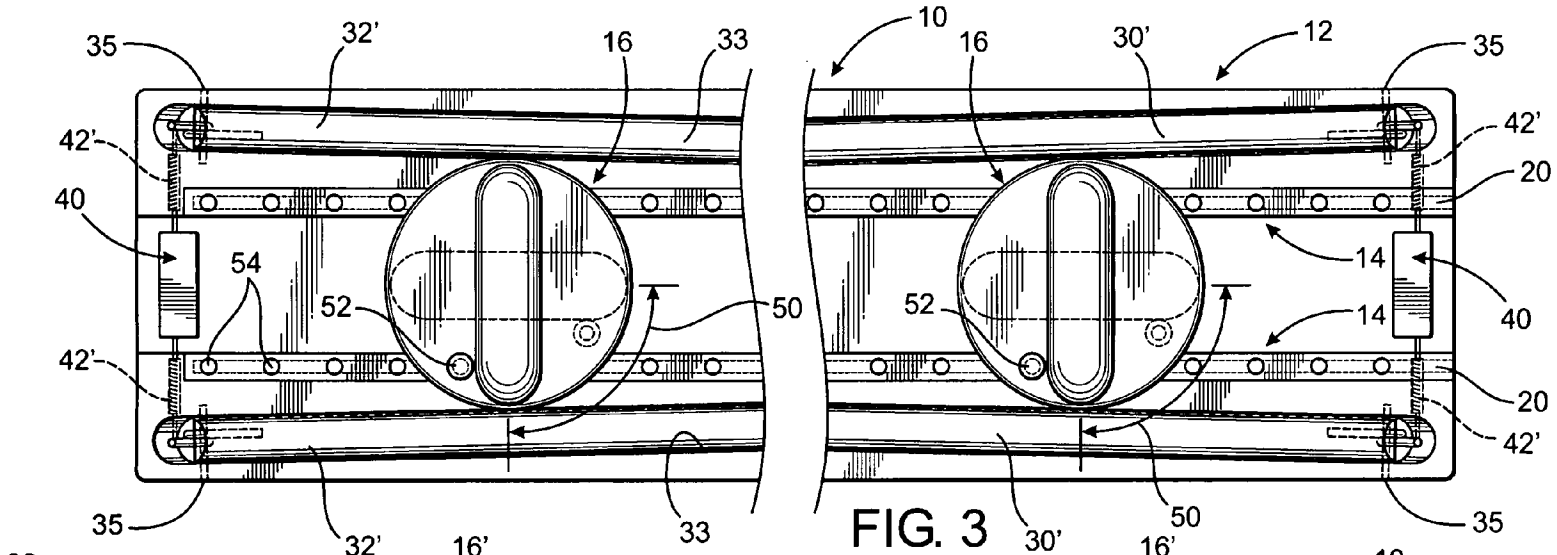
FIG. 3 is a top plan view of the embodiment of the FIGS. 1 and 2 in partial phantom.

In at least one preferred embodiment, the legs are "automatically" positioned from the non-supporting orientation of FIGS. 2 and 3 into the supporting orientation of FIG. 1, by manipulation of a release assembly, generally indicated as 40, and preferably disposed at each end of the base 12. Further, each release assembly 40 is operatively interconnected to a biasing assembly including at least one, but more practically a plurality of torsion springs or other appropriate biasing structures 42', disposed in biasing relation to the individual leg segments 30',30' and 32',32' of the leg structures 30 and 32 and also disposed at each end of the base 12. As such, the biasing structures or torsion springs 42 are disposed and structured to normally bias the corresponding leg structures 30 and 32 into the outwardly extending, supporting orientation as represented in FIG. 1 and as also partially represented in phantom lines in FIG. 4. An appropriate manual activation of the release assemblies 40 will selectively release the biasing force of the biasing structures 42. The released biasing force will then be exerted on the leg segments 30', 30' and 32', 32' in a manner which causes their "automatic" outwardly extended positioning into the aforementioned supporting orientation.

Further, appropriate mechanical linkage 42 and 43 will be disposed and structured to interconnect the release assemblies 40 to the one or more biasing structures 42' and also serve to removably retain the leg structures 30 and 32 in the non-supporting orientation. One or more different mechanical linkage assemblies may be utilized for this purpose and function. Therefore, regardless of the specific mechanical linkage utilized, the manipulation of the release assemblies 40 "releases" the leg structures 30 and 32, thereby facilitating their "automatic" disposition into the supporting orientation of FIGS. 1, as the biasing forces are exerted thereon by the biasing structures 42'. It should be further apparent that the leg structures 30 and 32, including each of the four leg segments 30'30' and 32'32', are pivotally attached, as at 35, to the base 12 so as to be pivotally disposed into and out of the supporting orientation of FIG. 1, as schematically represented by directional arrows 37.

As set forth above, the base 12 and accordingly the base 12, track assembly 14 and two body engaging members or hand grips 16 may be disposed in a plurality of at least two operative positions. With primary reference to FIG. 1, a first of the plurality of operative positions comprises the leg structures 30 and 32 being disposed in the supporting orientation, wherein the leg structures 30 and 32 extend outwardly from the interior of the compartments 33 formed in the base 12 into supported engagement with the supporting surface 47. When in this first operative position, the base 12 is disposed above the supporting surface 47 a sufficient distance to create a predetermined space 49 below the base 12 and between the base 12 and the supporting surface 47. Moreover, the dimension of the leg structures 30 and 32 may be varied by a telescoping or other extendable structure of the leg segments 30' and 32' as indicated at 30" and 32" in FIG. 1. This extendable feature of the leg structures 30 and 32 assures that the predetermined space 49 is of sufficient dimension to allow the positioning of an exercising individual at least partially within the predetermined space 49 and beneath the base 12 and track assembly 14, as schematically represented in phantom lines in FIG. 1. The first operative position is further defined by the plurality of hand grips 16 extending outwardly from the base 12 and the track assembly 14 in a direction towards the supporting surface 47. This outward extension of the hand grips 16 allows clear access of the individual to the hand grips 16 and enables the individual to perform a variety of different exercises such as, but not limited to sit-ups, crunches, etc., while engaging and concurrently moving the hand grips 16 outwardly and inwardly as also schematically represented in FIG. 1. Accordingly, as clearly represented in FIGS. 1 and 2, the first operative position further comprises the base 12, the track assembly 14 and the two body engaging members or hand grips 16 all disposed in an inverted orientation relative to the orientations thereof when in the second operative position represented in FIG. 2.

With primary reference to FIG. 2, a second of the plurality of operative positions of the base 12 and track assembly 14 is represented with the base 12 being disposed in confronting, supported engagement with the supporting surface 47. In addition, the second operative position of the base 12 and the track assembly 14 is further defined by the plurality of hand grips 16 extending outwardly from the base 12 and track assembly 14 in a direction away from the support assembly 47 on which the base 12 is supported. As should be apparent, the hand grips 16 extending outwardly from the base 12 and the track assembly 14 in a direction away from the support surface 47 allows the individual to perform yet an additional number and variety of exercises such as, but not limited to, push-ups or the like. Therefore, FIGS. 1 and 2 indicate that the hand grips 16 extend outwardly from the base 12 and the track assembly 14 in opposite directions towards the supporting surface 47 and away from the supporting surface 47, when the exercise assembly 10 is in the first operative position and the second operative position, respectively.

As set forth above, each of the hand grips 16 are movably connected to the track assembly 14 and more specifically to the track rails 20, as represented in FIG. 2. As such, each of the hand grips 16 are disposed and structured to move reciprocally along the length of the track assembly 14 by the forces exerted thereon by the exercising individual's hands grasping the different handles 16', as represented in phantom lines in FIGS. 1 and 2. Moreover, the linear, reciprocal movement of each of the hand grips 16 preferably, but not exclusively, occurs in opposite directions along different segments of the length of the track assembly 14, as the hands and arms of the exercising individual move in a corresponding manner and direction. More specifically, as the hands and arms of the exercising individual extend outwardly, away from one another in an extended or expanded orientation and then inwardly, toward one another, into a retracted position, the hand grips 16 engaged by the individual will correspondingly move in the same direction.

Further, the length of the base 12 and track assembly 14 is sufficient to at least provide the outward extension of the arms of the individual well beyond the position of the respective shoulders. Alternatively, when in the retracted, inwardly extended position, the arms and hands of the individual may be aligned with the shoulders of the individual or disposed inwardly of the shoulders, as generally represented in FIGS. 1 and 2. Moreover, during the crunch or sit-up type exercises performed by the individual when the exercise assembly 10 is in the first operative position of FIG. 1, the hand grips 16 as well the hands and arms of the individual may be reciprocally moved linearly in the outwardly extended position and in the inwardly, retracted position. Similarly, when the exercise assembly 10 is in the operative position of FIG. 2, the hand grips 16 may be similarly positioned in a linear, reciprocal direction of movement both in the outwardly, extended position and in the inwardly, retracted position.

Also with regard to FIGS. 1, 2, and 5-7, the relative sizes of the base 12 and the exercising individual are not necessarily represented in true proportions. More specifically, since the exercise assembly 10 is intended for use by individuals of all appropriate ages and genders, the size of the base 12 and track assembly 14 should be sufficient to enable an adult male individual to assume the maximum practical outwardly directed, extended position of his arms and hands and/or torso. When so dimensioned, the size of the exercise assembly 10, specifically including the length of the base 12 and track assembly 14, will be sufficient to accommodate smaller and/or younger individuals.

Figure 4:
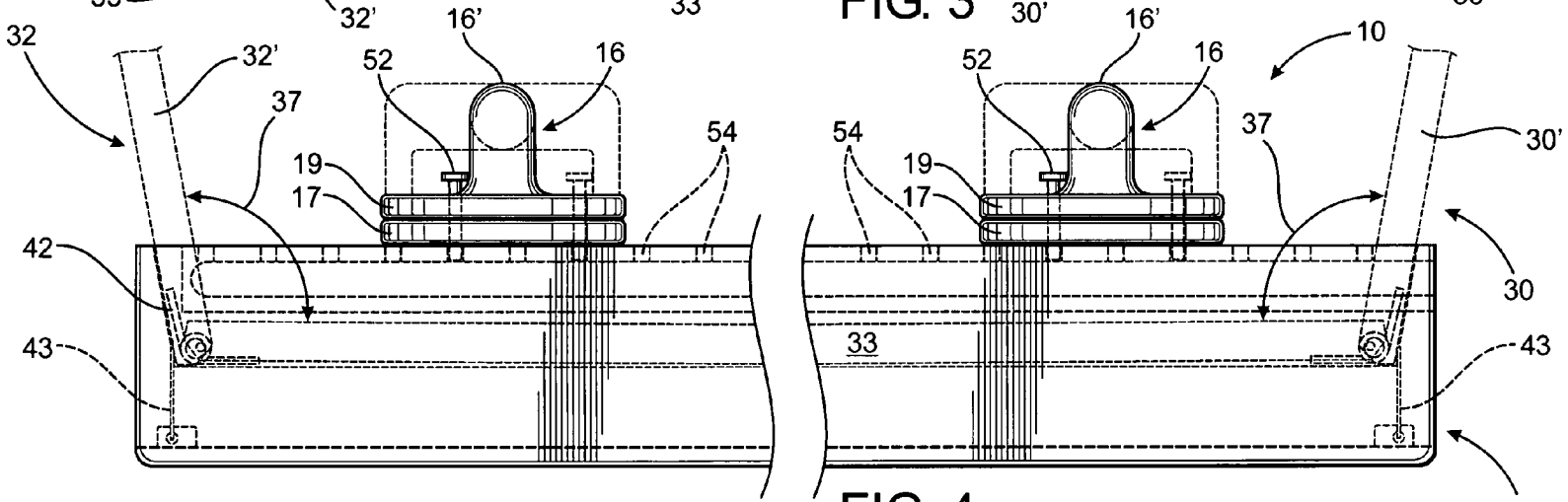
FIG. 4 is a side view of the embodiment of FIG. 3 in partial phantom.

With primary reference to the embodiments of FIGS. 3 and 4, additional versatility of the exercise assembly 10 is demonstrated by the ability of the hand grips 16, once the handles 16' are gripped by the hands of the individual, to be rotated relative to the base 12 and track assembly 14. Such rotational motion may be reciprocal in opposite directions, as schematically indicated by directional arrows 50. Alternatively, the hand grips 16 may be disposed in a fixed position through the provision of a locking assembly in the form of at least one locking pin 52 connected to and movable with each of the hand grips 16. More specifically, each of the hand grips 16 includes mounting segments 17 and 19. Segment 17 is movably interconnected to the track assembly 14 and/or track rail 20 so as to be capable of moving reciprocally along the length thereof. However, mounting segment 17 is not rotational about its own central axis relative to the track assembly 14.

The mounting segment 19 is connected to the mounting segment 17 so as to be movable with the mounting segment 17 along the length of the track assembly 14. In addition, mounting segment 19 is also rotationally connected to the mounting segment 17 such that it and the handle 16', fixedly connected thereto, may rotate relative to the mounting segment 17 and the track assembly 14. Accordingly, the mounting segment 19, as well as, the handle 16' of each of the hand grips 16 can reciprocally rotate, in accordance with the directional arrow 50 concurrently to the hand grips 16 traveling along the length of the track assembly 14, such as when engaged by the hands of the exercising individual. Therefore as the mounting segments 19 and handles 16' are reciprocally positioned along different lengths of the track assembly 14, the handle 16' may concurrently rotate such that the handles 16' may be substantially transversely oriented relative to the length of the track assembly 14, as represented in solid lines in FIGS 3 and 4 and/or movably disposed into substantial alignment with the track assembly 14, as represented in phantom lines in FIGS. 3 and 4. In correctly performing certain exercises, the individual may prefer to have each of the hand grips 16 substantially fixed relative to the track assembly in any of a variety of different locations along the length of the track assembly 14. When the hand grips 16 are fixed in this manner the handles 16' may still be rotationally disposed in a variety of orientations as represented in solid and phantom lines in FIGS. 3 and 4 and as described above. Therefore, each of the hand grips 16 are structured for selective reciprocal movement along the length of the track assembly 14 and/or rotational movement relative to the track assembly 14 and/or a removable but fixed positioning thereof at various locations along the length of the track assembly 14.

In order to accomplish the movable or fixed operation of each of the hand grips 16, at least one locking pin 52 is mounted on each of the hand grips 16 in cooperative, engageable but removable relation to one or both of the mounting segments 17 and 19, as well as the track rail 20 of the track assembly 14. More specifically, each of the mounting segments 17 includes a plurality of apertures or passage formed therein. Each of these apertures are disposed and structured to receive at least a portion of the pin 52 so as to allow it to pass there through. Further, each of the apertures formed in the mounting segment 17 as well as the pin 52 may be disposed in aligned relation with a plurality of openings or receiving apertures 54 formed in the track rails 20. The ability of each of the hand grips 16 to reciprocally move along the length of track assembly 14 or be fixedly but removably secured at various locations along the track 14, as well as a variation in the orientation of the handle 16' is at least partially dependent on the relative positions and/or interaction of the pins 52 and mounting segments 17 and 19. More specifically, the passage of the locking pin 52 through one or both of the mounting segments 17 and 19 and/or the disposition of the pin 52 through both of the mounting segments 17 and 19 and into a receiving, removable locking engagement with one of the receiving apertures 54 will define whether the hand grips are movable or fixed relative to the base 12. Therefore, when the locking pin 52 is disposed to pass through aligned apertures of the mounting segments 17 and 19 as well as, engage an aligned one of the receiving openings or apertures 54, the respective hand grip 16 will be removably locked into a predetermined location along the length of the track assembly 14. This is due to the fact that the locking pin 52 will connect the mounting segments 17 and 19 into fixed relation to one another and also removably but firmly connect each of the mounting segments 17 and 19 to one of the track rails 20 as the locking pin 52 passes into a correspondingly aligned receiving opening or aperture 54.

In contrast, the disengagement of the end of the locking pin 52 from any of the apertures 54 of the rail track 20 will still maintain the mounting segments 17 and 19 into engagement with one another such that rotation of handle 16' and the mounting segment 19 is prohibited. However, when the locking pin 52 is in this position, each of the hand grips 16 will still be allowed to reciprocally move along the length of the track assembly 14 in that the pin 52 no longer is connected to the track rail 20. Moreover, when the locking pin 52 of each of the hand grips 16 is raised or otherwise disposed in an orientation which it does not engage the track rail 20 or the mounting segment 17, the handle 16' as well as the mounting segment 19 are able to rotate relative to the mounting segments 17 and the track assembly 14 as well as concurrently move along the length thereof as described above.

Figure 5:
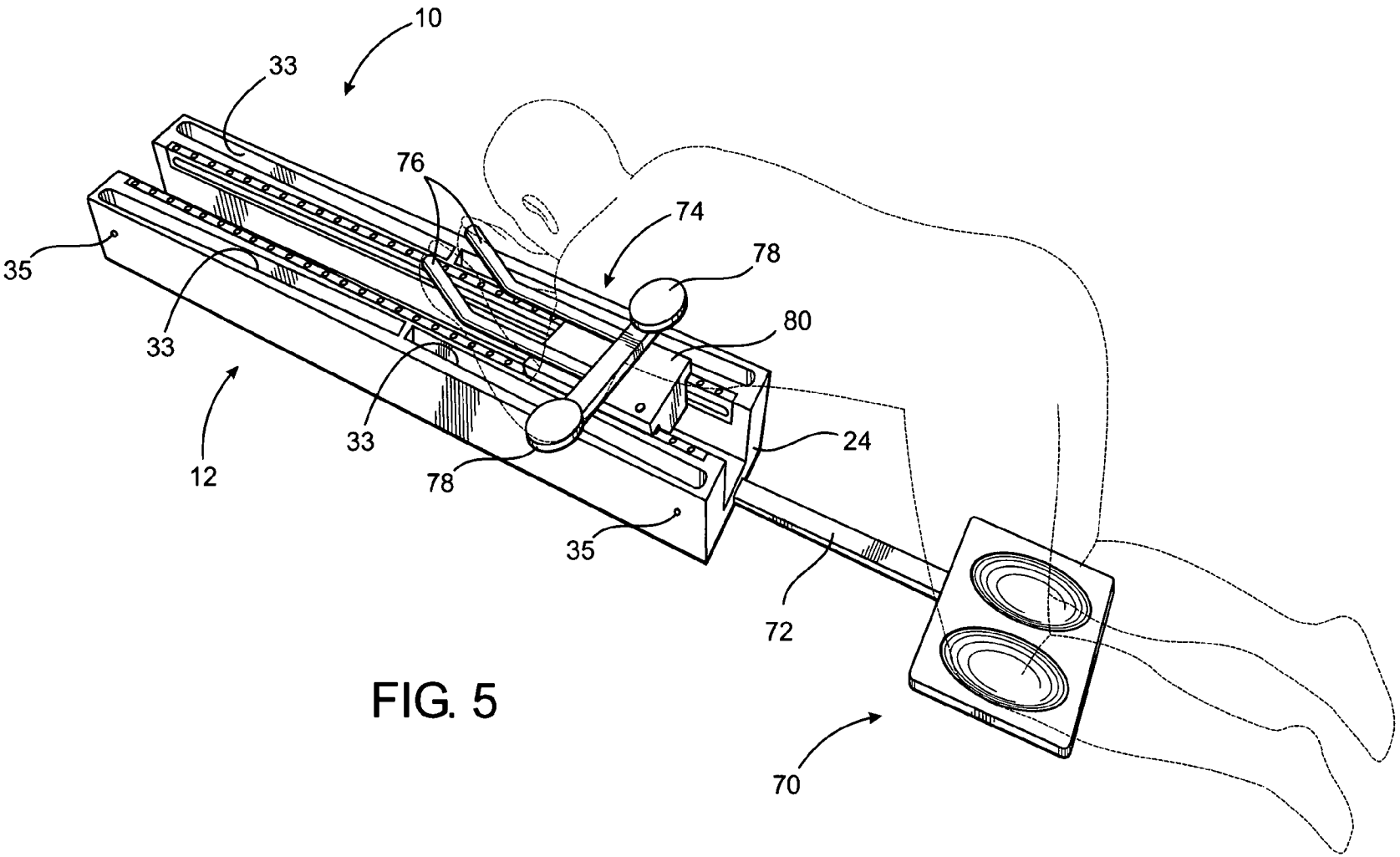
FIG. 5 is a perspective view in partial phantom of yet another preferred embodiment of the present invention.
Figure 6:
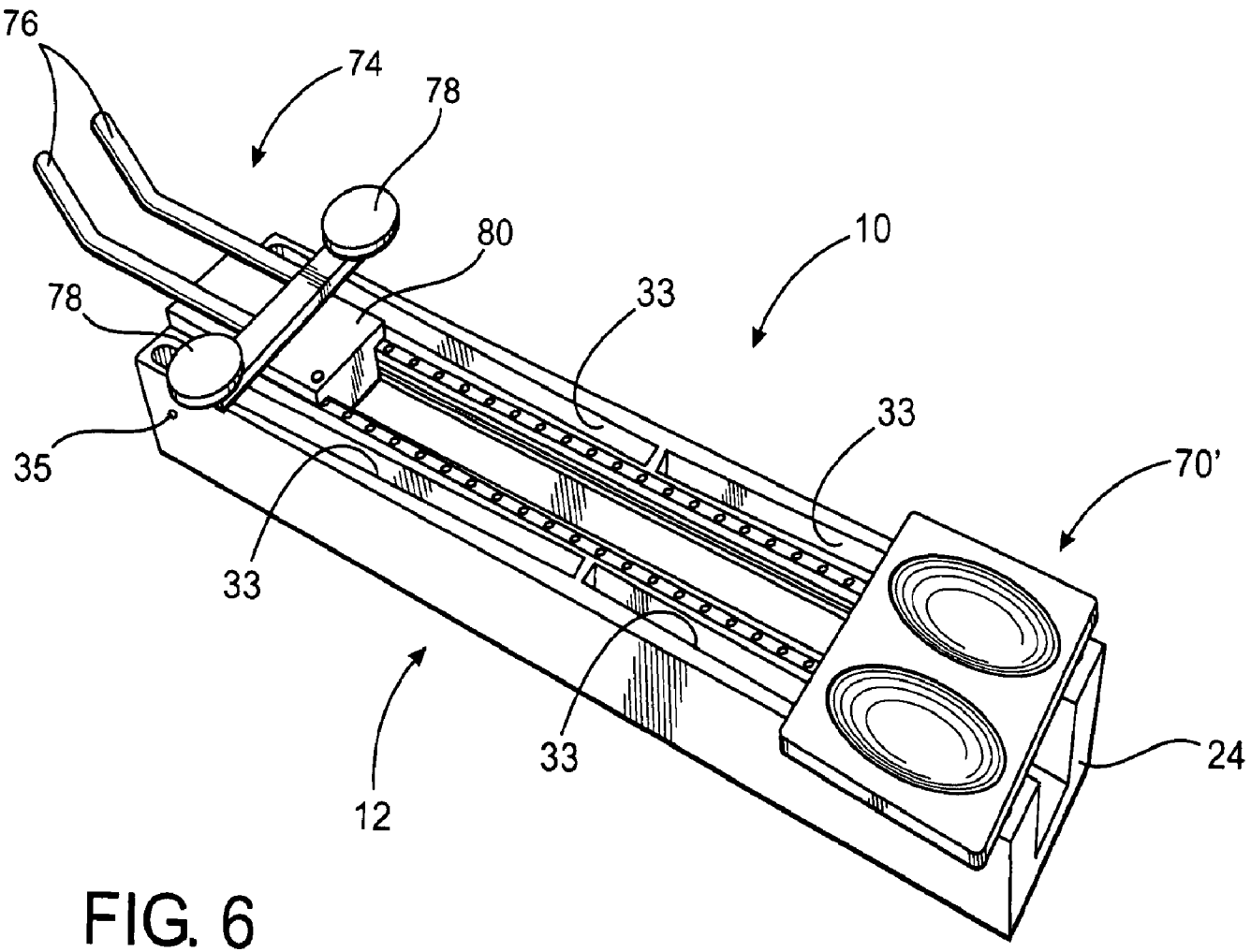
FIG. 6 is a perspective view of yet another preferred embodiment of the present invention similar to but distinguishable from the embodiment of FIG. 5.
Figure 7:
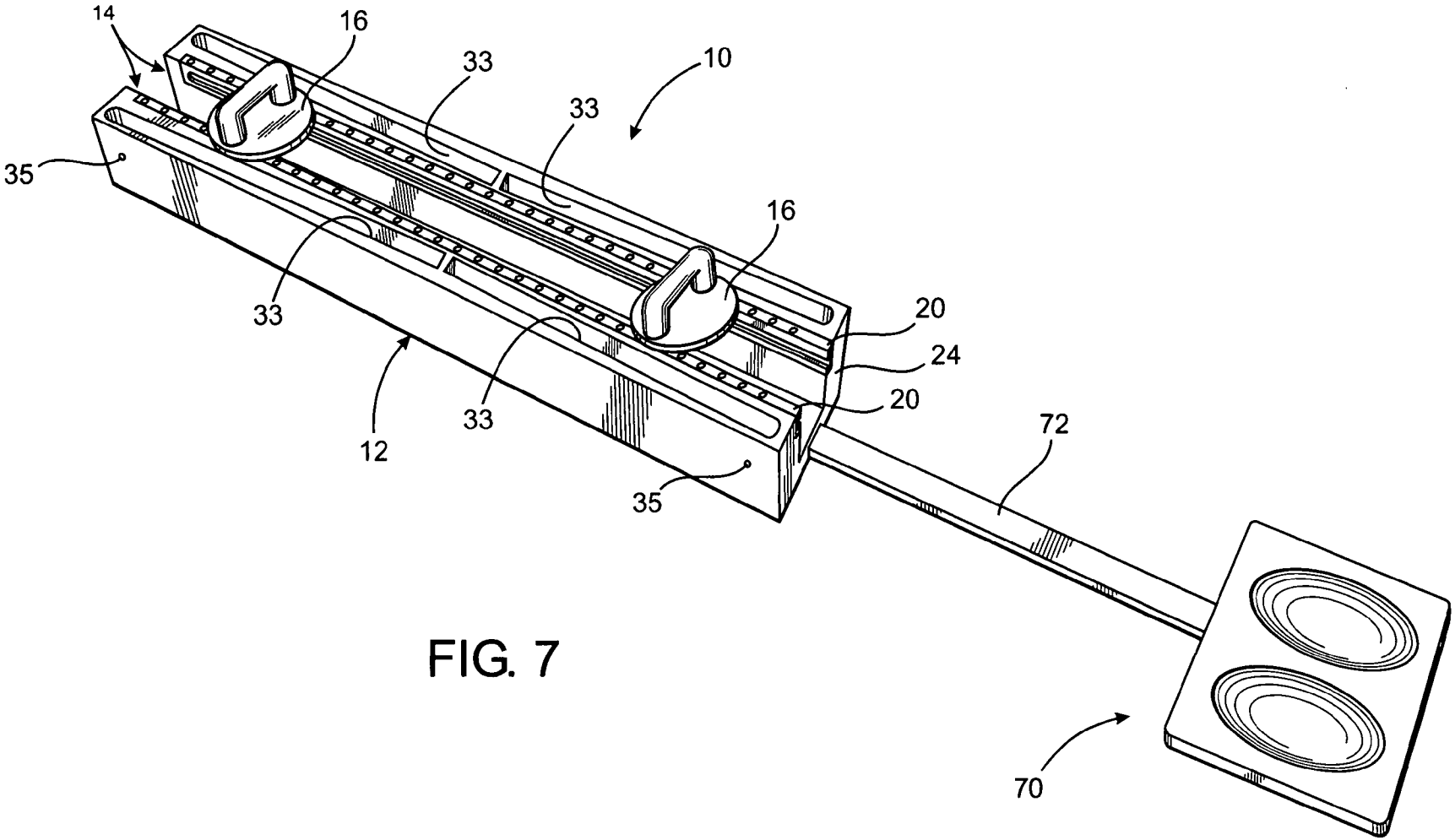
FIG. 7 is a perspective view of yet another preferred embodiment of the present invention similar to, but distinguishable from, the embodiment of FIGS. 5 and 6.

Yet additional preferred embodiments of the exercise assembly 10 of the present invention are represented in FIGS. 5 through 7. More specifically, the exercise assembly 10 may further include the provision of one or more accessories. As represented in FIGS. 5 and 7, such accessories comprise an outboard support structure generally indicated as 70, which may be movably or removably attached to the base 12, as represented. The outboard support structure 70 is disposed in confronting, supported relation to the supporting surface 47 when the base 12 and track assembly 14 are in the second operative position. A connecting link 72 movably and/or removably connects the outboard support structure 70 to the base 12 and may be variable in length, such that the distance or spacing of the outboard support structure 70 relative to a corresponding end 24 of the base 12 may be variable so as to accommodate individuals of different sizes.

A second of the possible plurality of accessories is represented in FIGS. 5 and 6 and comprises a body engaging member in the form of a handle assembly generally indicated as 74. The handle assembly 74 includes two outwardly extending, spaced apart handle members 76 capable of being gripped by the different hands of the exercising individual. Further, the handle assembly 74 may include supplementary supports 78, which are movable, with the handle members 76 on a platform 80. The platform 80 is reciprocally and linearly movable along the length of the track assembly 14 similar to the hand grips 16, as described above. The orientation of the exercising individual, as schematically represented in phantom lines in FIG. 5, may vary at least to the extent that different portions of the individual's body, other than the knees, may be supported on the outboard support structure 70. Similarly, when the handle members 76 are gripped by the hands of the individual, the elbows, forearms or other portions of the individual may rest on the supplemental supports 78. The reciprocal linear movement of the platform 80 along the length of the track assembly 14 allows the individual to perform "torso extensions" and other appropriate exercises. As such, the upper torso, abdomen, upper legs and arms of the individual may be appropriately exercised as should be apparent.

FIG. 6 represents another structural modification defining yet another embodiment of the exercise assembly 10 of the present invention, wherein torso extension exercises may also be performed. As represented, the support 70', rather than being located in spaced relation from the base 12, is fixed or mounted for reciprocal movement relative to the track assembly 14. More specifically, the support 70' is sufficiently structured to support both knees or other appropriate portions of the user's body concurrently to the hands, forearms, elbows of the individual engaging the handle assembly 74, of the type described in detail with reference to FIG. 5. While not disclosed in detail, the support 70' may be mounted on a movable platform such as platform 80 associated with the handle assembly 74 and also described above.

With regard to the embodiment of FIG. 7, only the single accessory in the form of the outboard support structure 70 is utilized and the provision of the handle assembly 74 is absent. Accordingly, in the embodiment of FIG. 7 the exercising individual may assume a similar position as that represented in FIG. 5 but grip at least one of the hand grips 16 to accomplish the aforementioned linear and reciprocal movement while in the exercising orientation of FIG. 5.

Accordingly the structural arrangement of the various accessories used in combination with remainder of the exercise assembly 10 of the preferred embodiments of FIGS. 5 through 7 allows the individual to perform "torso extensions" and other appropriate exercises. As such, the upper torso, abdomen, upper legs and arms of the individual may be appropriately exercised as should be apparent.

Figure 8:
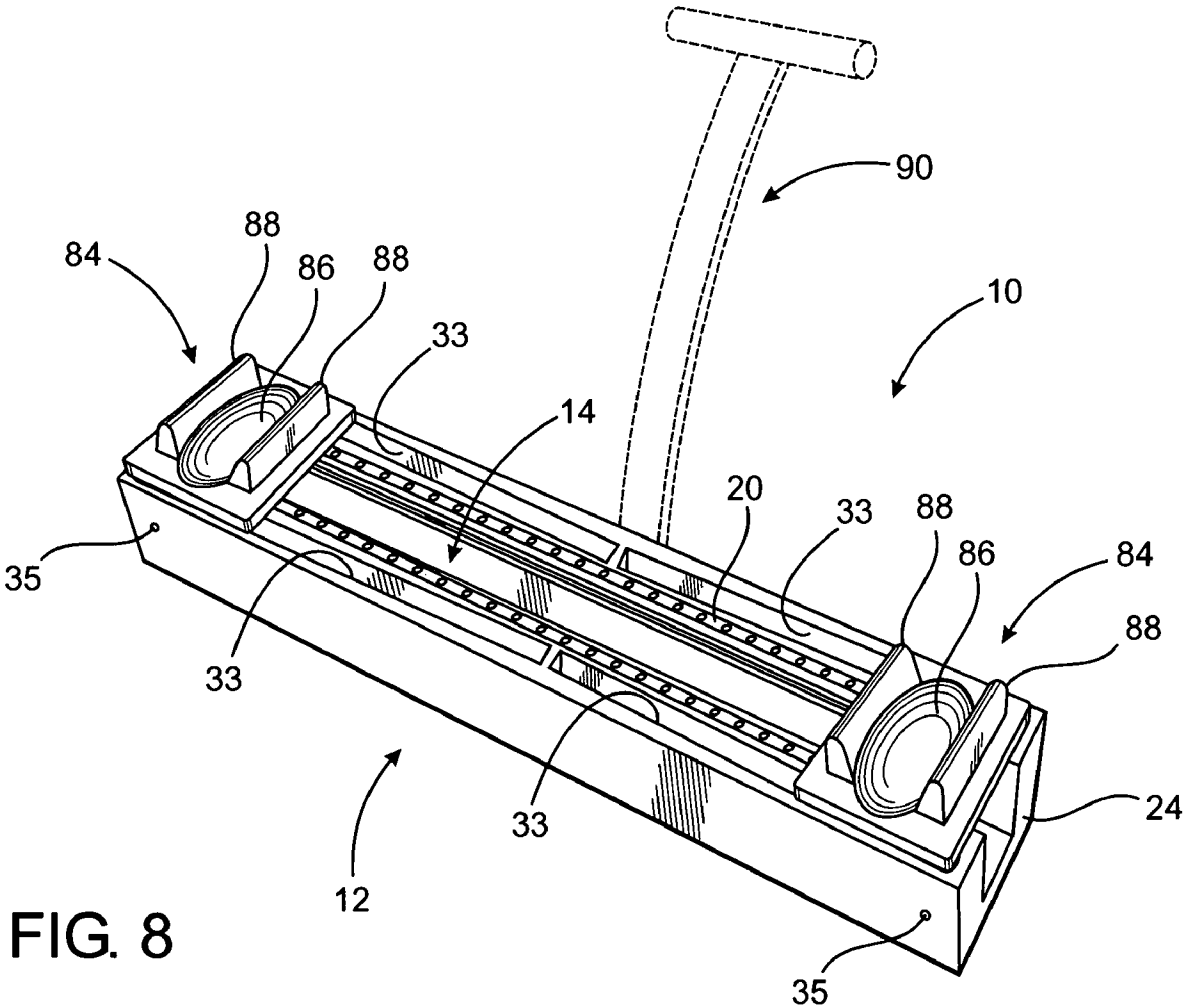
FIG. 8 is a perspective view of yet another preferred embodiment of the present invention differing in structure and operation from the embodiments of FIGS. 5-7.

With primary reference to FIG. 8, yet another embodiment of the exercise assembly 10 of the present invention comprises the use of additional accessories in the form of preferably two body engaging members 84. Each of the body engaging members 84 are cooperatively structured with the base 12, track assembly 14 and track rails 20 so as to reciprocally move along the length thereof in the manner similar to the hand grip 16 as demonstrated in FIGS. 1 and 2. Further, each of the body engaging members 84 include recessed or other appropriately configured portions 86 disposed and dimensioned to receive and support one knee of the exercising individual. Therefore when the individual has each of the knees placed on a different one of the body engaging members 84 he/she will be able to perform a "split-type" of exercise. This split like exercise may be more specifically described as the individual repeatedly spreading apart and subsequently bringing together the legs while the knees are supported within the recess portions 86. Further, each of the body engaging members 84 may include retaining members in the form of upwardly or outwardly extending flanges 88 which will aid the individual in performing the aforementioned split type exercises and further serve to aid in the retention of each knee in a corresponding one of the recessed portions 86. When it is desired to form this split-type or category of exercise, the hand grips 16 and/or other accessories of the type represented in FIGS. 5-7 are removed from the track assembly and the body engaging members 84 are substituted. Further, while not specifically disclosed, each of the body engaging members 84 may be movably supported on the track assembly 14 by a platform type of structure 80, as represented in FIGS. 5 and 6.

In order to provide a reasonable amount of stability to the exercising individual when performing the split-type exercises, a stanchion or other type stability member, generally indicated as 90, may be utilized. As such, the stabilizing member 90 may be connected to the base 12 and/or the supporting surface on which the base 12 is positioned and extend upwardly and outwardly therefrom, so as to be readily accessible to the exercising individual concurrently to the individual's knees being movably supported on the body engaging members 84. Additional structural features associated with the preferred embodiment of FIG. 8 may include the recessed portions or areas 86 formed of a soft, flexible, resilient, compressible, etc. material in order that the individual's knees are comfortably and securely disposed on the body engaging members 84.

Since many modifications, variations and changes in detail can be made to the described preferred embodiment of the invention, it is intended that all matters in the foregoing description and shown in the accompanying drawings be interpreted as illustrative and not in a limiting sense. As just one example, the inventor hereof contemplates that the track assembly could be modified from the rails and mechanical system described herein and yet rendered usable within the scope of the invention. As just one other example, the inventor hereof contemplates that the exercise assembly of the present invention could also readily be utilized with one or more add-on devices so as to offer the user an ability to perform "variable resistance" exercises as well, which may include incorporating a large, exercise type of rubber band into the assembly or a pulley system with weights, or even a hydraulic system with weights. Thus, the scope of the invention should be determined by the appended claims and their legal equivalents.

Now that the invention has been described,

What is claimed is:

1. An exercise assembly structured to facilitate performance of a plurality of different exercises by an individual, said exercise assembly comprising:

a base comprising an elongated configuration, a track assembly disposed on said base and extending along a length of said base in longitudinal alignment therewith, at least two body engaging members each mounted on said base in movable relation to said track assembly, a support assembly movably connected to said base and positionable thereon in a supporting orientation or a non-supporting orientation, a first operative position of said base and said track assembly comprising said support assembly disposed in said supporting orientation relative to a supporting surface, said two body engaging members and said track assembly disposed in facing relation to the supporting surface, and base disposed a predetermined distance above the supporting surface, a second operative position of said base and said track assembly comprising said support assembly disposed in a non-supporting orientation relative to the supporting surface and said base disposed in confronting engagement with the supporting surface, said first operative position further comprising said track assembly, said base and said at least two body engaging members disposed in an inverted orientation relative to the respective orientations thereof when in said second operative position, and said two body engaging members cooperatively structured with said track assembly to reciprocally and linearly move along said track assembly when said track assembly, said base and said two body engaging members are in either said inverted orientation of said first operative position or said second operative position.

2. An exercise assembly as recited in claim 1 wherein said two body engaging members comprise two hand grips and said first operative position further comprises said two hand grips extending outwardly from said track assembly in said inverted orientation and in a direction towards the supporting surface.

3. An exercise assembly as recited in claim 2 wherein said second operative position further comprises said two hand grips extending outwardly from said track assembly in a direction away from the supporting surface.

4. An exercise assembly as recited in claim 1 wherein said two body engaging members comprise two hand grips and said first and second operative positions are respectively and at least partially defined by said two hand grips collectively extending outwardly from said track assembly in substantially opposite directions.

5. An exercise assembly as recited in claim 1 wherein said two body engaging members comprise two hand grips;

a locking assembly disposed and structured to independently secure each of said two hand grips in any one of a plurality of different fixed locations along the length of said track assembly.

6. An exercise assembly as recited in claim 5 wherein said locking assembly is removably disposable in interconnecting relation between said track assembly and each of said two hand grips.

7. An exercise assembly as recited in claim 5 wherein said locking assembly is removably disposable in interconnecting relation between each of said two hand grips and said track assembly at any one of said plurality of different locations along the length of said track assembly.

8. An exercise assembly as recited in claim 5 wherein each of said two hand grips are rotationally movable relative to said track assembly concurrent to said reciprocal and linear movements thereof.

9. An exercise assembly as recited in claim 5 wherein each of said two hand grips are rotationally movable relative to said track assembly independently of said reciprocal and linear movement thereof.

10. An exercise assembly as recited in claim 1 wherein said two body engaging members comprise two hand grips, each of said two hand grips rotationally movable relative to said track assembly concurrently to said reciprocal and linear movement thereof along said track assembly.

11. An exercise assembly as recited in claim 1 further comprising a biasing assembly disposed in interconnecting relation between said base and said support assembly; said biasing assembly structured to normally bias said support assembly in said supporting orientation.

12. An exercise assembly as recited in claim 11 further comprising a release assembly disposed on said base in retaining engagement with said support assembly concurrent to disposition of said support assembly in said non-supporting orientation and said second operative position.

13. An exercise assembly as recited in claim 12 wherein said release assembly is detachably connected to said support assembly; said biasing assembly further disposed and structured to bias said support assembly into said supporting orientation and said first operative position upon detachment of said support assembly from said release assembly.

14. An exercise assembly as recited in claim 13 further comprising a release mechanism disposed on said base in operative relation to said release assembly, said release mechanism structured to selectively detach said release assembly from said retaining engagement with said support assembly.

15. An exercise assembly as recited in claim 1 wherein said support assembly comprises at least two leg structures each movably connected to said base in spaced relation to one another and disposable between said supporting and non-supporting orientations.

16. An exercise assembly as recited in claim 15 wherein said first operative position of said base and said supporting orientation of said support assembly comprises said two leg structures extending transversely outward from said base in supported engagement with the supporting surface.

17. An exercise assembly as recited in claim 16 wherein said second operative position of said base and said non-supporting orientation of said support assembly comprises said two leg structures disposed in substantially aligned relation with the length of said base and out of supporting engagement with the supporting surface.

18. An exercise assembly as recited in claim 17 wherein each of said two leg structures are at least partially rotationally connected to said base and pivotally disposed between said supporting and non-supporting orientations.

19. An exercise assembly as recited in claim 16 wherein said two leg structures comprise a sufficient longitudinal dimension to facilitate disposition of the individual beneath said base when said base is in said first operative position, said support assembly is in said supporting orientation and said body engaging members and said track assembly are disposed in said inverted orientation.

20. An exercise assembly as recited in claim 1 further comprising at least one accessory connected to said base and structured to facilitate the performance of additional ones of the plurality of exercises by the individual, when said base is in said second operative position.

21. An exercise assembly as recited in claim 20 wherein said one accessory comprises an outboard support structure disposed in supported engagement with the supporting surface and in spaced relation to said base and in substantially aligned relation to the length of said base.

22. An exercise assembly as recited in claim 21 further including at least one other accessory comprising a handle assembly connected to said track assembly and reciprocally movable along the length of said track assembly.

23. An exercise assembly as recited in claim 22 wherein said outboard support structure and said handle assembly are detachably connected to said base.

24. An exercise assembly as recited in claim 22 wherein said handle assembly comprises two handles each having an elongated configuration and extending outwardly from said base in an adjacent, spaced, substantially upright, and parallel relation to one another.

25. An exercise assembly as recited in claim 1 further comprising a plurality of accessories including at least two body engaging members each movable along a length of said track assembly, said plurality of accessories structured to facilitate the performance of additional ones of the plurality of exercises by the individual, when said base is in said second operative position.

26. An exercise assembly as recited in claim 25 wherein each of said two body engaging members is dimensioned and structured to removably support a different knee of the individual.

27. An exercise assembly as recited in claim 25 wherein said plurality of accessories include a body support structure and a handle assembly each structured to independently move along a length of said track assembly

28. An exercise assembly as recited in claim 27 wherein said handle assembly comprises two handles each having an elongated configuration and extending outwardly from said base in an adjacent, spaced, substantially upright relation to one another.

29. An exercise assembly structured to facilitate performance of a plurality of different exercises by an individual thereon, said exercise assembly comprising:

a base comprising an elongated configuration, a track assembly disposed on said base and extending along a length of said base in longitudinal alignment therewith, at least two hand grips each mounted on said base in movable relation to said track assembly, a support assembly comprising at least two leg structures each movably connected to said base in spaced relation to one another, said two leg structures positionable on said base in a supporting orientation and a non-supporting orientation, a first operative position comprising said base, said track assembly and said two hand grips disposed to facilitate performance of at least a first plurality of exercises by the individual, said first operative position of said base and said track assembly comprising said support assembly disposed in said supporting orientation relative to a supporting surface, said at least two hand grips extending outwardly from said track assembly in a direction towards the supporting surface and said track assembly disposed a predetermined distance above the supporting surface, a second operative position of said base and said track assembly disposed to facilitate performance of a second plurality of exercises by the individual, said base disposed in confronting engagement with the supporting surface, said first operative position further comprising said track assembly, said base and said two hand grips disposed in an inverted orientation relative to the respective orientations thereof when in said second operative position, said two hand grips cooperatively structured with said track assembly to reciprocally and linearly move along said track assembly when said track assembly, said base and said two hand grips are in either said inverted orientation of said first operative position or said second operative position, and at least one accessory connected to said base and structured to facilitate the performance of at least a third plurality of exercises by the individual utilizing said accessory assembly concurrent to said base, said track assembly and said two hand grips being disposed in said second operative position.

30. An exercise assembly as recited in claim 29 wherein said accessory assembly comprises an outboard support structure disposed in supported engagement on the supporting surface in spaced relation to said base and in aligned relation to the length of said base.

31. An exercise assembly as recited in claim 30 further comprising at least a second accessory including a handle assembly reciprocally connected to said track assembly and including two handles each having an elongated configuration and extending outwardly from said base in an adjacent, spaced, substantially parallel relation to one another.

32. An exercise assembly as recited in claim 31 wherein said outboard support structure is detachably connected to said base.

33. An exercise assembly as recited in claim 31 wherein said outboard support structure and said handle assembly are detachably connected to said base.

34. An exercise assembly as recited in claim 31 wherein each of said two leg structures comprise two leg segments, each leg segment having a sufficient longitudinal dimension to facilitate disposition of the individual beneath said base and at least partially within said predetermined space when said base is in said first operative position and said support assembly is in said supporting orientation.

* * * * *